US009147978B2

(12) United States Patent
Akuta

(10) Patent No.: US 9,147,978 B2
(45) Date of Patent: Sep. 29, 2015

(54) SHIELD CONNECTOR

(75) Inventor: Daisuke Akuta, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/351,775

(22) PCT Filed: Mar. 1, 2012

(86) PCT No.: PCT/JP2012/055174

§ 371 (c)(1),
(2), (4) Date: Apr. 14, 2014

(87) PCT Pub. No.: WO2013/054551

PCT Pub. Date: Apr. 18, 2013

(65) Prior Publication Data

US 2014/0235092 A1 Aug. 21, 2014

(30) Foreign Application Priority Data

Oct. 12, 2011 (JP) ..... 2011-225053

(51) Int. Cl.

| | |
|---|---|
| ***H01R 13/627*** | (2006.01) |
| ***H01R 13/6581*** | (2011.01) |
| ***H01R 13/506*** | (2006.01) |
| ***H01R 13/6592*** | (2011.01) |
| *H01R 9/03* | (2006.01) |

(52) U.S. Cl.

CPC ..... *H01R 13/6581* (2013.01); *H01R 13/506* (2013.01); *H01R 13/6272* (2013.01); *H01R 13/6592* (2013.01); *H01R 9/032* (2013.01)

(58) Field of Classification Search

USPC ..... 439/353

See application file for complete search history.

(56) References Cited

U.S. PATENT DOCUMENTS

| | | | | |
|---|---|---|---|---|
| 5,419,721 | A | 5/1995 | Lignelet | |
| 5,437,564 | A | 8/1995 | Lignelet | |
| 6,716,071 | B2 * | 4/2004 | Miyazaki | 439/859 |
| 7,614,910 | B2 * | 11/2009 | Croteau et al. | 439/573 |
| 7,731,543 | B2 | 6/2010 | Aoki et al. | |
| 7,934,950 | B2 | 5/2011 | Yong | |

(Continued)

FOREIGN PATENT DOCUMENTS

| | | |
|---|---|---|
| JP | 07-099073 | 4/1995 |
| JP | 07-099074 | 4/1995 |

(Continued)

OTHER PUBLICATIONS

International Search Report of May 9, 2012.

*Primary Examiner* — Jean F Duverne

(74) *Attorney, Agent, or Firm* — Gerald E. Hespos; Michael J. Porco; Matthew T. Hespos

(57) ABSTRACT

A shield connector (10) includes a connector housing (20) with resiliently deformably provided resilient locking pieces (25), a collective shield shell (50) formed with collective side engaging portions (56) engageable with the resilient locking pieces (25), and an individual core shield shell (30) formed with individual-core side engaging portions (38) engageable with the resilient locking pieces (25). Either one of the collective and individual core shield shells (50, 30) is selectively fixed to the connector housing (20) by engaging the resilient locking pieces (25) and the collective side engaging portions (56) when the collective shield shell (50) is mounted onto the connector housing (20) or engaging the resilient locking pieces (25) and the individual-core side engaging portions (38) when the individual core shield shell (3) is mounted onto the connector housing (20).

3 Claims, 10 Drawing Sheets

(56) References Cited

U.S. PATENT DOCUMENTS

| | | | | |
|---|---|---|---|---|
| 7,959,468 | B2 | 6/2011 | Yong et al. | |
| 8,342,880 | B2 * | 1/2013 | Kato et al. | 439/595 |
| 8,460,015 | B2 * | 6/2013 | Deno et al. | 439/98 |
| 2001/0029120 | A1 * | 10/2001 | Miyazaki et al. | 439/98 |
| 2004/0266261 | A1 * | 12/2004 | Miyazaki | 439/587 |

FOREIGN PATENT DOCUMENTS

| | | |
|---|---|---|
| JP | 2008-235190 | 10/2008 |
| JP | 2008-262811 | 10/2008 |
| JP | 2009-87888 | 4/2009 |
| JP | 2010-113910 | 5/2010 |
| JP | 2010-165512 | 7/2010 |

* cited by examiner

SHIELD CONNECTOR

BACKGROUND

1. Field of the Invention

The present invention relates to a shield connector.

2. Description of the Related Art

Conventionally, a collective shield connector for collectively shielding a plurality of wires is known from Japanese Unexamined Patent Publication No. 2010-113910, and an individual core shield connector for individually shielding a plurality of wires is known from Japanese Unexamined Patent Publication No. 2010-165512.

The collective shield connector includes a collective connector housing from which the plurality of wires are drawn out backward and a collective shield shell to be mounted onto a rear part of the collective connector housing. The collective shield shell includes a collective insertion portion which is open in a front-back direction and into which the plurality of wires are collectively inserted, and the plurality of wires drawn out backward from the collective connector housing are collectively shielded by covering this collective insertion portion by a braided wire. Further, the collective connector housing includes a pair of resilient locking pieces which are resiliently deformable, and these resilient locking pieces are inserted into the collective insertion portion from front and engaged with a rear end opening edge part of the collective insertion portion from behind, whereby the collective shield shell is mounted onto the rear part of the collective connector housing.

On the other hand, the individual core shield connector includes an individual core connector housing from which the plurality of wires are drawn out backward and an individual core shield shell to be mounted onto a rear part of the individual core connector housing. The individual core shield shell includes a plurality of individual core insertion portions into which the plurality of wires are individually inserted in the front-back direction, and each wire drawn out backward from the individual core connector housing is shielded by covering each individual core insertion portion by a braided wire. Further, the individual core shield shell is formed with locking holes provided before the individual core insertion portions and extending in a direction perpendicular to a wire draw-out direction and a pair of resilient locking pieces provided on the individual core connector housing are engaged with inner peripheral edge parts of these locking holes, whereby the individual core shield shell is mounted onto the rear part of the individual core connector housing.

If there are two types of shield connectors for collective shielding and for individual shielding as described above, it is necessary to manage two types of connector housings and shield shells and parts management may become inefficient.

The present invention was completed in view of the above situation and an object thereof is to reduce the number of components by using a common connector housing onto which collective and individual core shield shells are to be mounted.

SUMMARY OF THE INVENTION

To achieve the above object, the present invention is directed to a shield connector, including a connector housing which is made of synthetic resin, from which a plurality of wires are drawn out and which includes a resilient locking piece provided resiliently deformably in a direction intersecting with a draw-out direction in which the plurality of wires are drawn out; a collective shield shell which is made of metal and includes a collective shield connecting portion, which is open in the draw-out direction of the plurality of wires and into which the plurality of wires are collectively inserted, a collective side engaging portion engageable with the resilient locking piece being formed on the collective shield connecting portion; and an individual core shield shell which includes a wall portion arranged to intersect with the draw-out direction of the plurality of wires, a plurality of individual core shield connecting portions, which are open in the draw-out direction of the plurality of wires, being provided on the wall portion, whereby the plurality of wires are individually inserted into the individual core shield connecting portions, and an individual-core side engaging portion engageable with the resilient locking piece being formed on the wall portion; wherein the collective shield shell or the individual core shield shell is selectively fixed to the connector housing by resiliently restoring the resiliently deformed resilient locking piece and engaging the resilient locking piece with the collective side engaging portion when the collective shield shell is mounted onto the connector housing or by resiliently restoring the resiliently deformed resilient locking piece and engaging the resilient locking piece with the individual-core side engaging portion when the individual core shield shell is mounted onto the connector housing.

According to the thus configured shield connector, the collective shield connector or the individual core shield connector can be selectively assembled with the connector housing by engaging the resilient locking piece with the collective side engaging portion of the collective shield connector or with the individual-core side engaging portion of the individual core shield connector. Specifically, the connector housing can be shared by the collective shield connector and the individual core shield connector. This can reduce the number of components and facilitate parts management.

The following configurations are preferable as embodiments of the present invention.

The collective side engaging portion may be an opening edge part of the collective shield connecting portion; the individual-core side engaging portion may be an opening edge part of a through hole provided to penetrate through the wall portion in the draw-out direction of the plurality of wires; the connector housing may be formed to be fittable into a mounting hole provided on a case made of metal; each of the collective shield shell and the individual core shield shell may be formed with a mounting piece for mounting the shield shell on the case by tightening a bolt into the case in a direction intersecting with a fitting direction of the connector housing; and the resilient locking piece may be formed to be resiliently deformable in a direction intersecting with both the fitting direction of the connector housing and a tightening direction of the bolt.

In the case of fitting the connector housing into the mounting hole of the case and fixing the shield shell to the case by the mounting piece through which the bolt is tightened in the direction different from the fitting direction of the connector housing, the shield shell may be fixed to the case while being slightly displaced in the tightening direction of the bolt, for example, by being pressed in the tightening direction of the bolt due to manufacturing tolerances of the connector housing and the shield shell and an assembling tolerance between the connector housing and the mounting piece. In such a state, an engagement margin between the resilient locking piece and the collective side engaging portion or the individual-core side engaging portion is reduced if a resilient deforming direction of the resilient locking piece and the tightening direction of the bolt are the same. However, according to the configuration as described above, since the resilient locking piece is formed resiliently deformably in the direction intersecting with the tightening direction of the bolt, the engagement margin between the resilient locking piece and the collective side engaging portion or the individual-core side engaging portion is not reduced even if the engaged position of the resilient locking piece and the collective side engaging portion or the individual-core side engaging portion is slightly displaced. This can suppress a reduction in a force for locking each shield shell by the resilient locking piece as compared with the case where the resilient deforming direction of the resilient locking piece and the tightening direction of the bolt are the same.

An opening of the collective shield connecting portion and an opening of the through hole may be formed to be larger than the resilient locking piece in a width direction.

According to such a configuration, if the fitting direction of the connector housing and the tightening direction of the bolt differ, the resilient locking piece is displaced in the tightening direction of the bolt relative to the collective side engaging portion or the individual-core side engaging portion, thereby being able to absorb the manufacturing tolerances and the assembling tolerance between the connector housing and the shield shell. This can reduce the application of a stress caused by bolt tightening between an opening edge part of the collective shield connecting portion and the resilient locking piece and between an opening edge part of the through hole and the resilient locking piece as compared with the case where a width of each engaging portion and that of the resilient locking piece are the same.

The resilient locking piece may be formed at each of opposite sides of a wire draw-out portion from which the plurality of wires are drawn out.

According to such a configuration, each shield shell can be held in a well-balanced manner at the opposite sides of the wire draw-out portion, wherefore the force for locking each shield shell by the resilient locking piece can be improved.

EFFECT OF THE INVENTION

According to the present invention, it is possible to reduce the number of components by using a common connector housing onto which collective and individual core shield shells are to be mounted.

DETAILED DESCRIPTION OF THE PREFERRED EMBODIMENTS

An embodiment of the present invention is described with reference to FIGS. 1 to 10.

Figure 8:
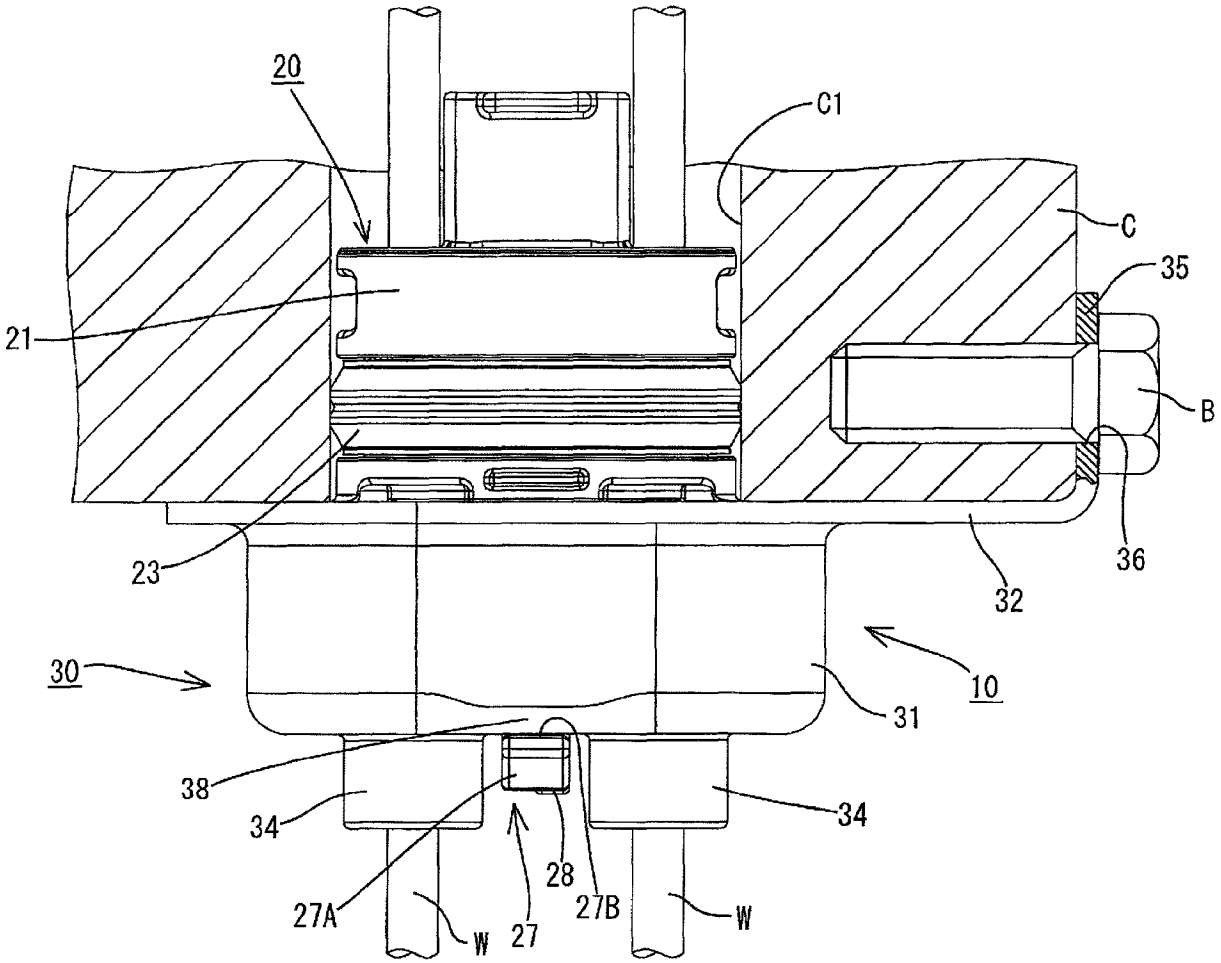
FIG. 8 is a plan view partly in section showing a state where a shield connector is fixed to a case.

In this embodiment, a shield connector 10 is illustrated which is fixed to a case C made of metal by being fitted into a mounting hole C1 provided on the case C and fastened by a bolt as shown in FIG. 8.

Figure 7:
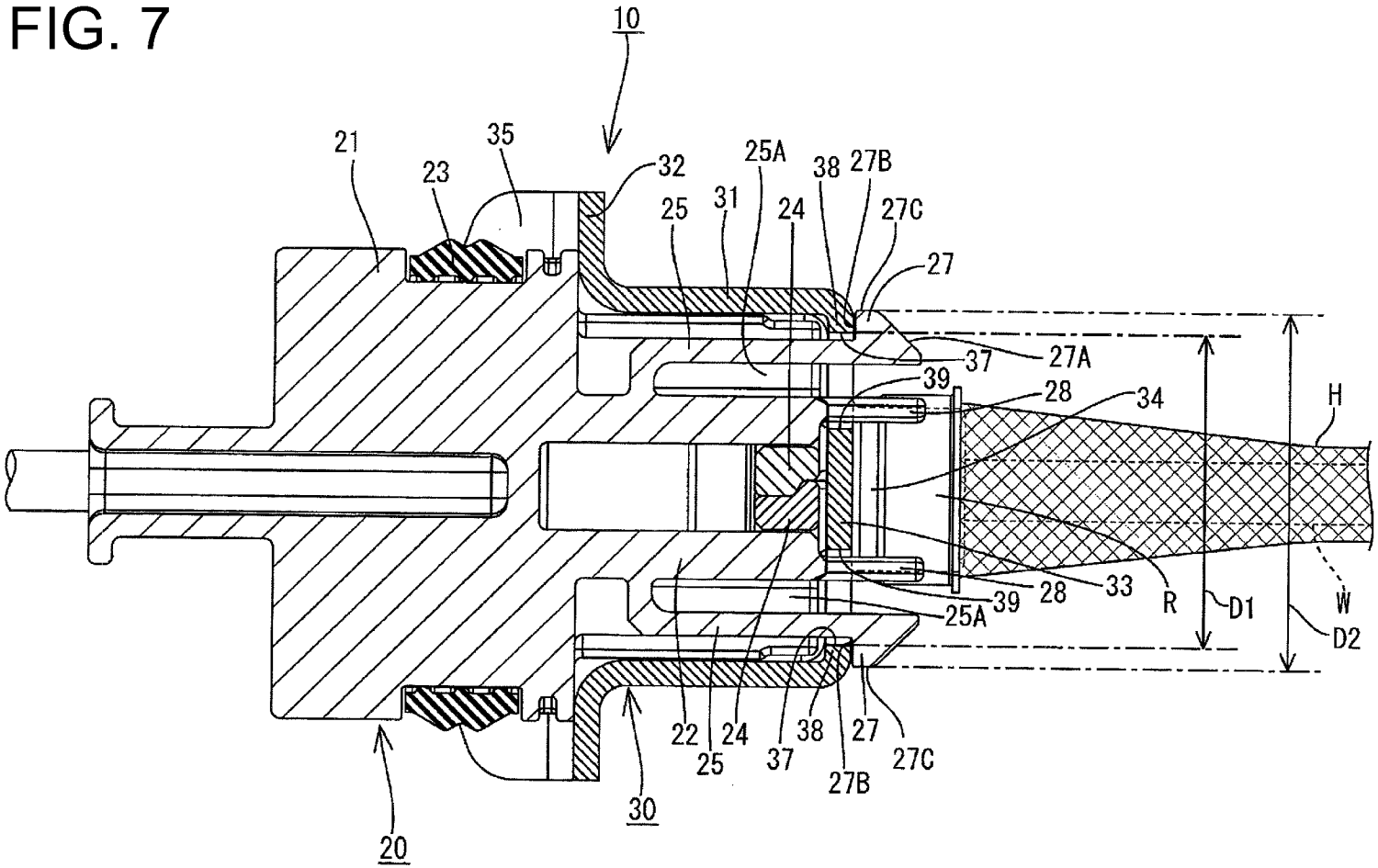
FIG. 7 is a section along VII-VII of FIG. 6.
Figure 10:
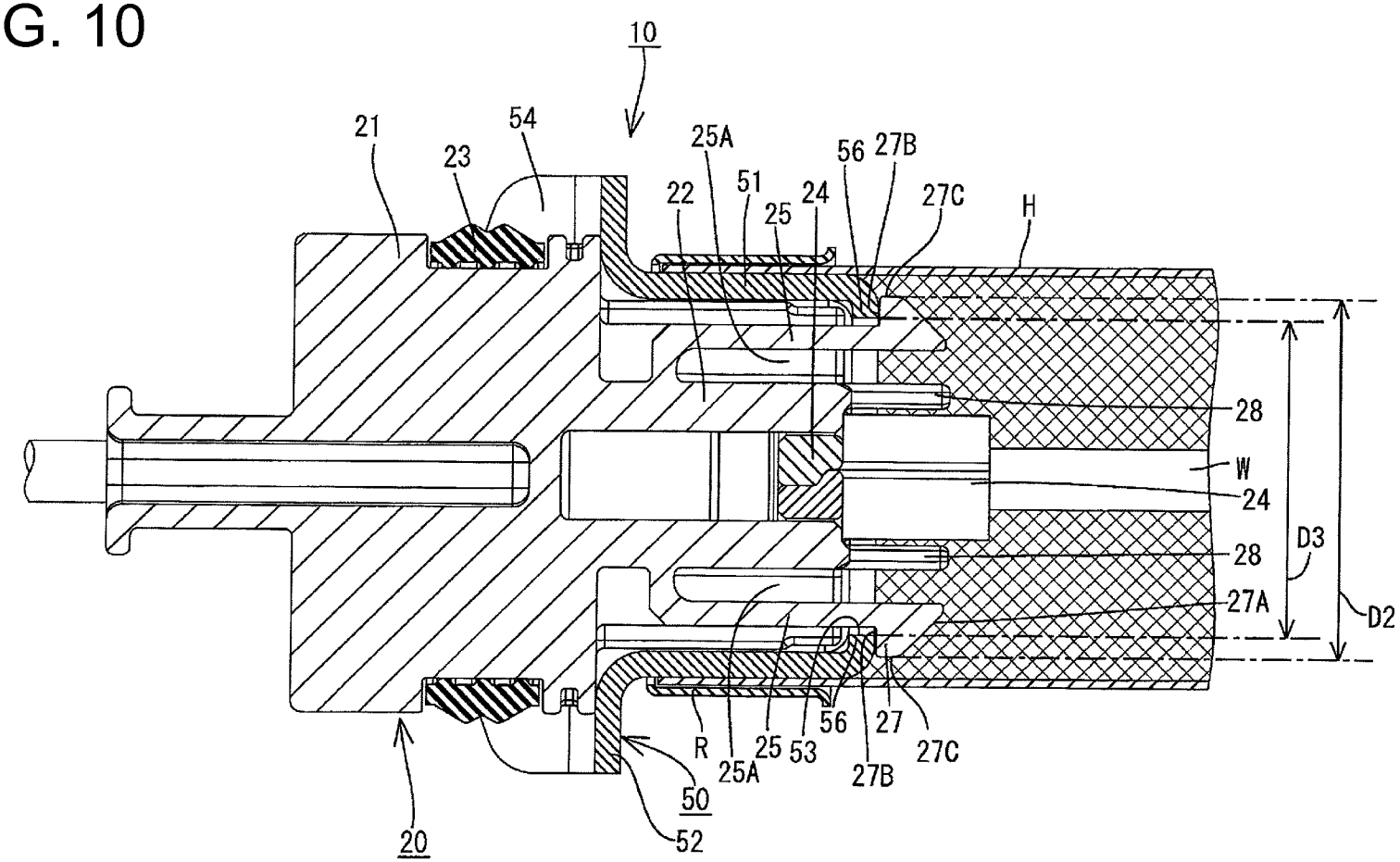
FIG. 10 is a section showing a state where the connector housing and the collective shield shell are assembled.

As shown in FIGS. 7 and 10, the shield connector 10 includes a connector housing 20 made of synthetic resin, an individual core shield shell 30 and a collective shield shell 50 made of metal and to be selectively mounted onto the connector housing 20 from behind.

Figure 1:
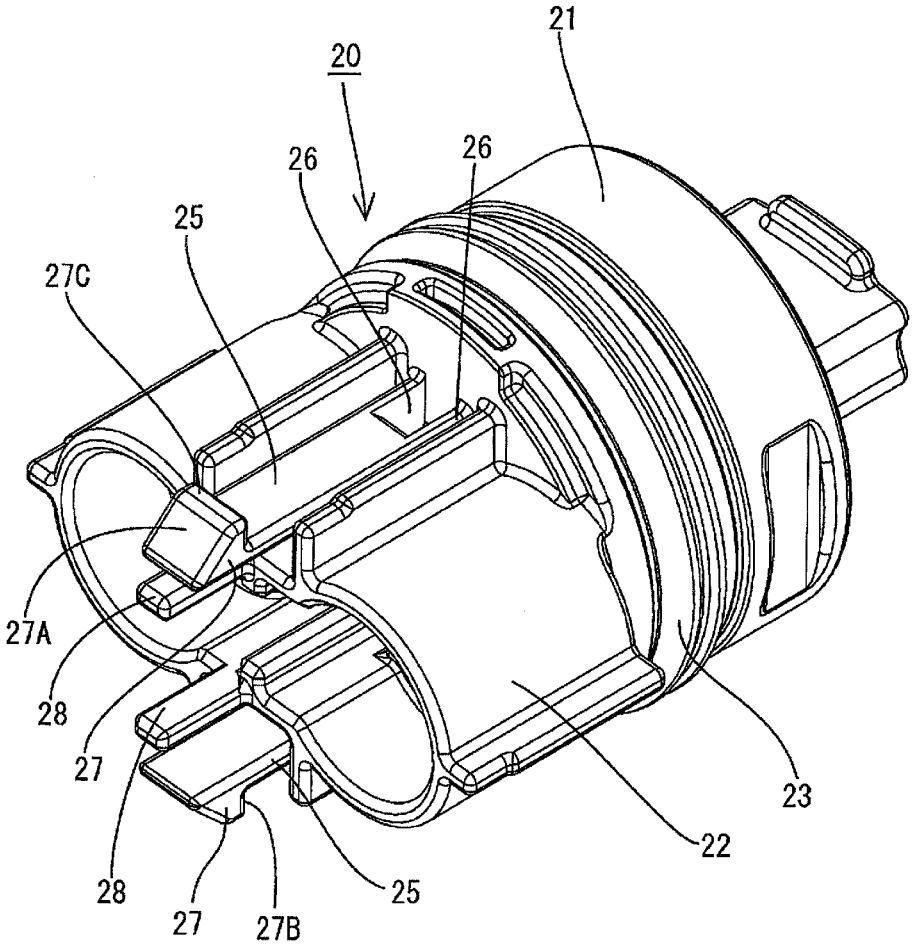
FIG. 1 is a perspective view of a connector housing when obliquely viewed from a rear upper side.
Figure 2:
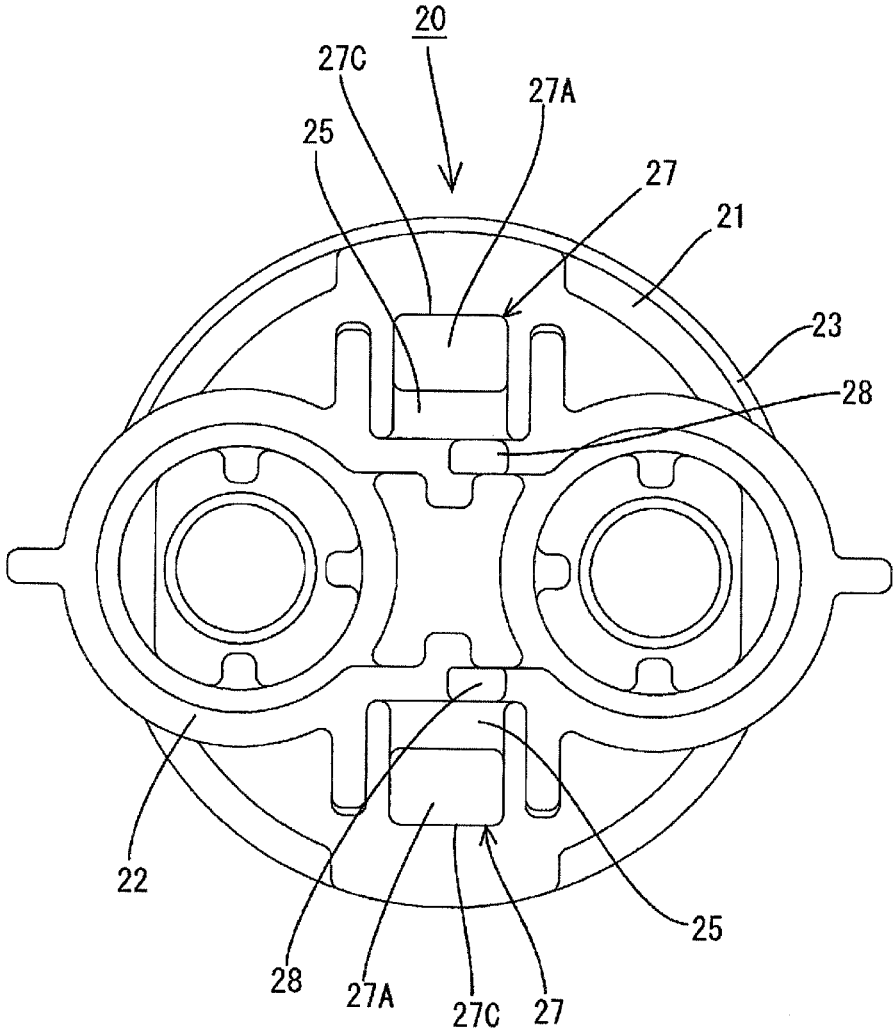
FIG. 2 is a rear view of the connector housing.

As shown in FIGS. 1 and 2, the connector housing 20 includes a fitting portion 21 fittable into the mounting hole C1 of the case C and a wire holding portion (an example of a "wire draw-out portion" of the present invention) 22 formed to extend backward from the rear surface of this fitting portion 21. The fitting portion 21 has a substantially hollow cylindrical shape and a rubber ring 23 is mounted on the outer peripheral surface of the fitting portion 21. As shown in FIG. 8, the rubber ring 23 is held in close contact with the inner peripheral surface of the mounting hole C1 and the outer peripheral surface of the fitting portion 21 to seal between the fitting portion 21 and the inner peripheral surface of the mounting hole C1 when the fitting portion 21 is fitted into the mounting hole C1 of the case C.

The wire holding portion 22 is smaller than the fitting portion 21 in a vertical direction and larger than the fitting portion 21 in a width direction, and formed into a tubular shape penetrating in a front-back direction. As shown in FIGS. 7 and 10, a pair of upper and lower holders 24 to be externally fitted to a plurality of (two in this embodiment) wires W by sandwiching the both wires W from upper and lower sides are held in the wire holding portion 22. Two wires W are drawn out backward from a rear end opening of the wire holding portion 22. Note that unillustrated rubber plugs held in close contact with the inner peripheral surface of the wire holding portion 22 and the outer peripheral surfaces of the wires W are mounted in the wire holding portion 22 and sealing is provided between the wire holding portion 22 and the wires W by these rubber plugs.

The individual core shield shell 30 is formed by drawing an electrically conductive metal plate material. Further, as shown in FIGS. 3 and 4, the individual core shield shell 30 includes a tubularly formed shell main body 31, a flange portion 32 formed on the front end edge of the shell main body 31, a rear wall (an example of a "wall portion" of the present invention) 33 formed on a rear end part of the shell main body 31, and a pair of individual core shield connecting portions 34 projecting backward from the rear wall 33.

The shell main body 31 has an elliptical cross-section and is formed to be long in the width direction. As shown in FIGS. 7 and 8, the wire holding portion 22 of the connector housing 20 is housed in the shell main body 31.

Figure 3:
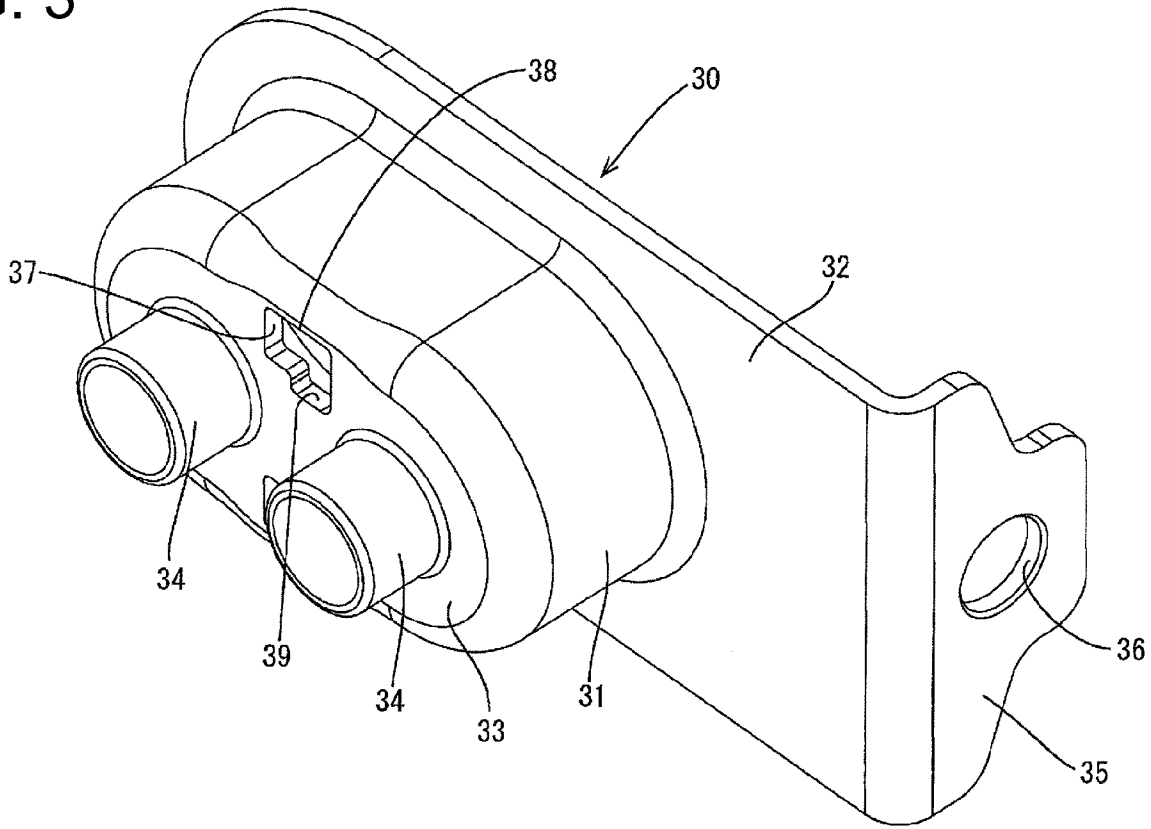
FIG. 3 is a perspective view of an individual core shield shell when obliquely viewed from a rear upper side.
Figure 4:
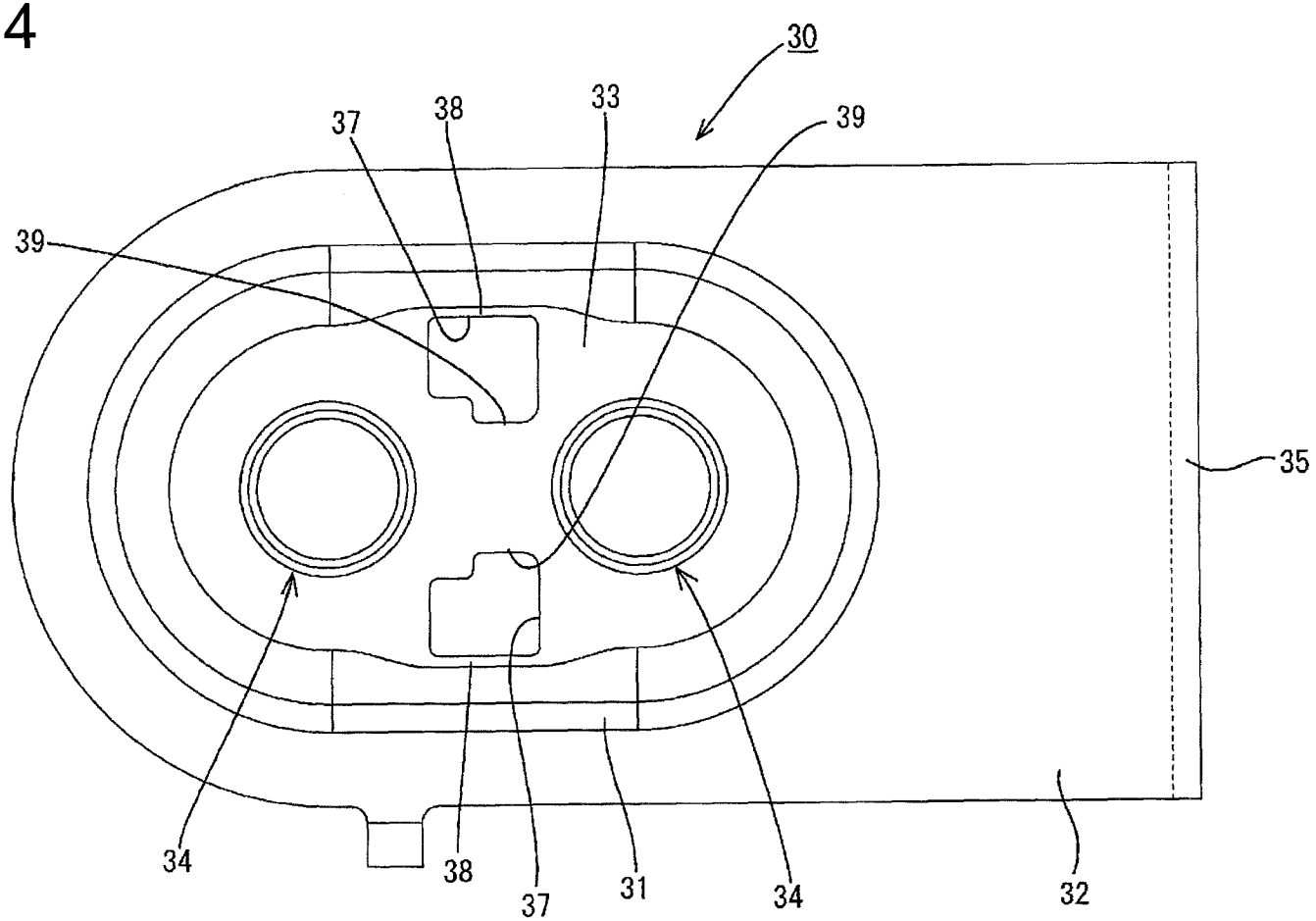
FIG. 4 is a rear view of the individual core shield shell.

As shown in FIGS. 3, 7 and 8, the flange portion 32 is formed to project outward from the front end edge of the shell main body 31 over the entire circumference, and the individual core shield shell 30 is stopped so as not to be displaced forward from a proper position by the contact of the flange portion 32 with the rear surface of the fitting portion 21 of the connector housing 20 from behind. Further, the flange portion 32 is formed to largely project from the outer peripheral surfaces of the fitting portion 21 and the wire holding portion 22 of the connector housing 20. When the fitting portion 21 is fitted into the mounting hole C1 of the case C, the flange portion 32 comes into surface contact with an outer peripheral edge part of the mounting hole C1, whereby the flange portion 32 and the case C are shield-connected. A mounting piece 35 is formed to extend forward from the right end edge of the flange portion 32. The mounting piece 35 is formed with a bolt insertion hole 36 penetrating in the width direction perpendicular to the fitting direction of the fitting portion 21, and the individual core shield shell 30 is reliably fixed to the case C and reliably shield-connected to the case C by inserting a bolt B into the bolt insertion hole 36 and tightening the bolt B into the case C in the width direction.

The rear surface 33 is arranged to intersect with the draw-out direction of the wires W drawn out backward from the wire holding portion 22, and the pair of individual core shield connecting portions 34 are formed side by side in the width direction on the rear surface of the rear wall 33.

Each individual core shield connecting portion 34 has a hollow cylindrical shape and is formed to penetrate in the front-back direction. The wires W drawn out backward from the wire holding portion 22 are individually inserted into the individual core shield connecting portions 34. A braided wire H is crimped to the outer peripheral surface of each individual core shield connecting portion 34 by a crimp ring R, and the wire W drawn out backward from the individual core shield connecting portion 34 is shielded by being individually covered by the braided wire H.

Note that although not shown, all the wires W drawn out backward from the individual core shield connecting portions 34 can also be collectively shielded by collectively covering all the wires W by a braided wire H and crimping the braided wire H to the outer peripheral surface of the shell main body 31 of the individual core shield shell 30.

Figure 9:
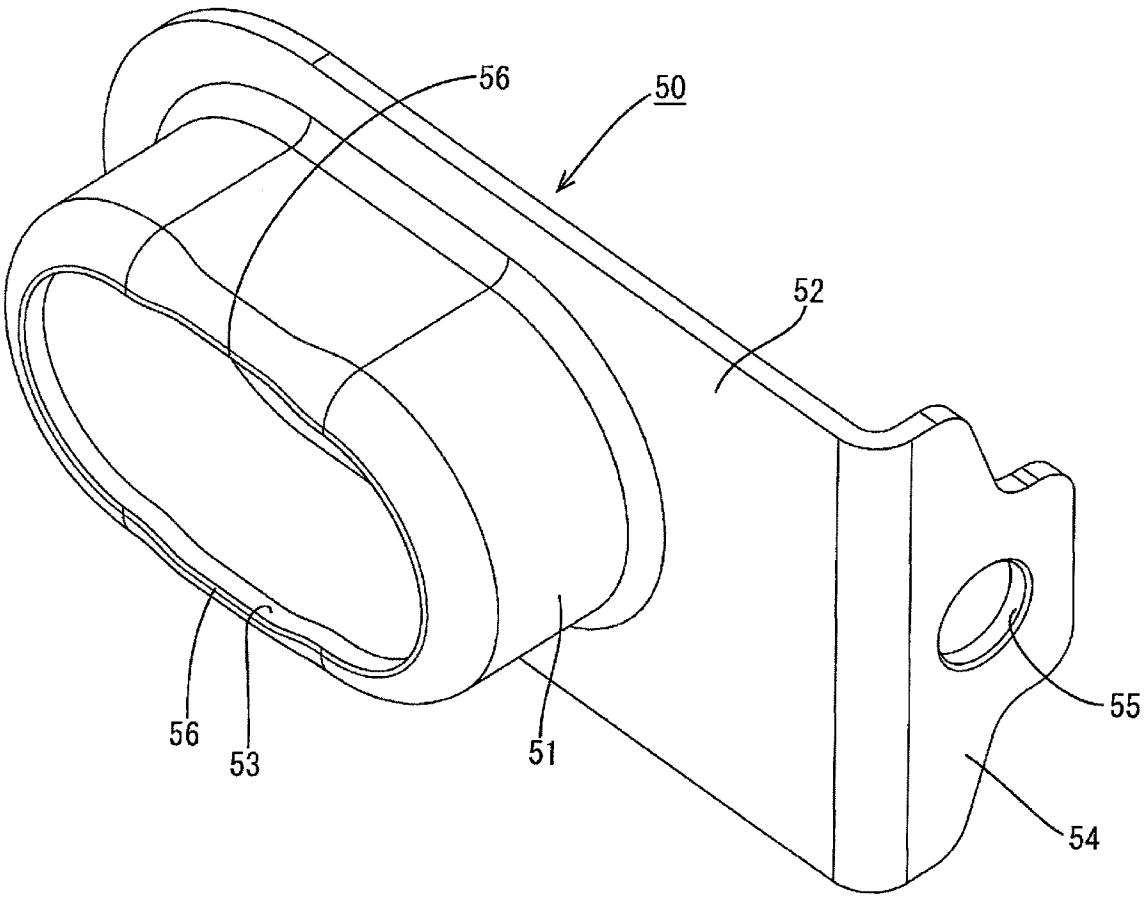
FIG. 9 is a perspective view of a collective shield shell when obliquely viewed from a rear upper side.

Similarly to the individual core shield shell 30, the collective shield shell 50 is formed by drawing an electrically conductive metal plate material. Further, as shown in FIGS. 9 and 10, the collective shield shell 50 includes a tubularly formed collective shield connecting portion 51 and a flange portion 52 provided on the front end edge of the collective shield connecting portion 51.

The collective shield connecting portion 51 has open front and rear ends and a large elliptical cross-section and is formed to be laterally long in the width direction. The wire holding portion 22 of the connector housing 20 is housed in the collective shield connecting portion 51. A rear end opening of the collective shield connecting portion 51 serves as a collective insertion hole 53 into which all the wires W drawn out backward from the wire holding portion 22 are collectively inserted, and all the wires W drawn out backward from the wire holding portion 22 are drawn out backward from the collective insertion hole 53. Further, a braided wire H is crimped to the outer peripheral surface of the collective shield connecting portion 51 by a crimp ring R, and all the wires W drawn out backward from the collective insertion hole 53 are shielded by being collectively covered by the braided wire H.

The flange portion 52 is formed to project outward from the front end edge of the collective shield connecting portion 51 over the entire circumference, and the collective shield shell 50 is stopped so as not to be displaced forward from a proper position by the contact of the flange portion 52 with the rear surface of the fitting portion 21 of the connector housing 20. Further, the flange portion 52 is formed to largely project from the outer peripheral surfaces of the fitting portion 21 and the wire holding portion 22 of the connector housing 20. When the fitting portion 21 is fitted into the mounting hole C1 of the case C, the flange portion 52 comes into surface contact with the outer peripheral edge part of the mounting hole C1, whereby the flange portion 52 and the case C are shield-connected. A mounting piece 54 is formed to extend forward from the right end edge of the flange portion 52. The mounting piece 54 is formed with a bolt insertion hole 55 penetrating in the width direction perpendicular to the fitting direction of the fitting portion 21, and the collective shield shell 50 is reliably fixed to the case C and reliably shield-connected to the case C by inserting the bolt B into the bolt insertion hole 55 and tightening the bolt B into the case C in the width direction.

A pair of resilient locking pieces 25 which are vertically resiliently deformable are formed at opposite upper and lower sides of the wire holding portion 22 of the connector housing 20. As shown in FIGS. 1 and 7, each resilient locking piece 25 is cantilevered backward from the outer surface of the wire holding portion 22. Further, the resilient locking piece 25 is flat in the width direction and opposite end parts of a front end part thereof in the width direction are integrally coupled to rear end parts of a pair of reinforcing walls 26 extending from the rear surface of the fitting portion 21 while facing each other in the width direction. Further, a locking projection 27 projecting outward is formed on the rear end part of each resilient locking piece 25. The locking projection 27 has an inclined surface 27A which becomes more distant from the wire holding portion 22 as it extends forward from the rear end edge of the resilient locking piece 25, and a locking surface 27B extending forward a short distance from the rear end of the inclined surface 27A and extending in the vertical direction from the rear end of this forwarding extending part toward the resilient locking piece 25.

Figure 5:
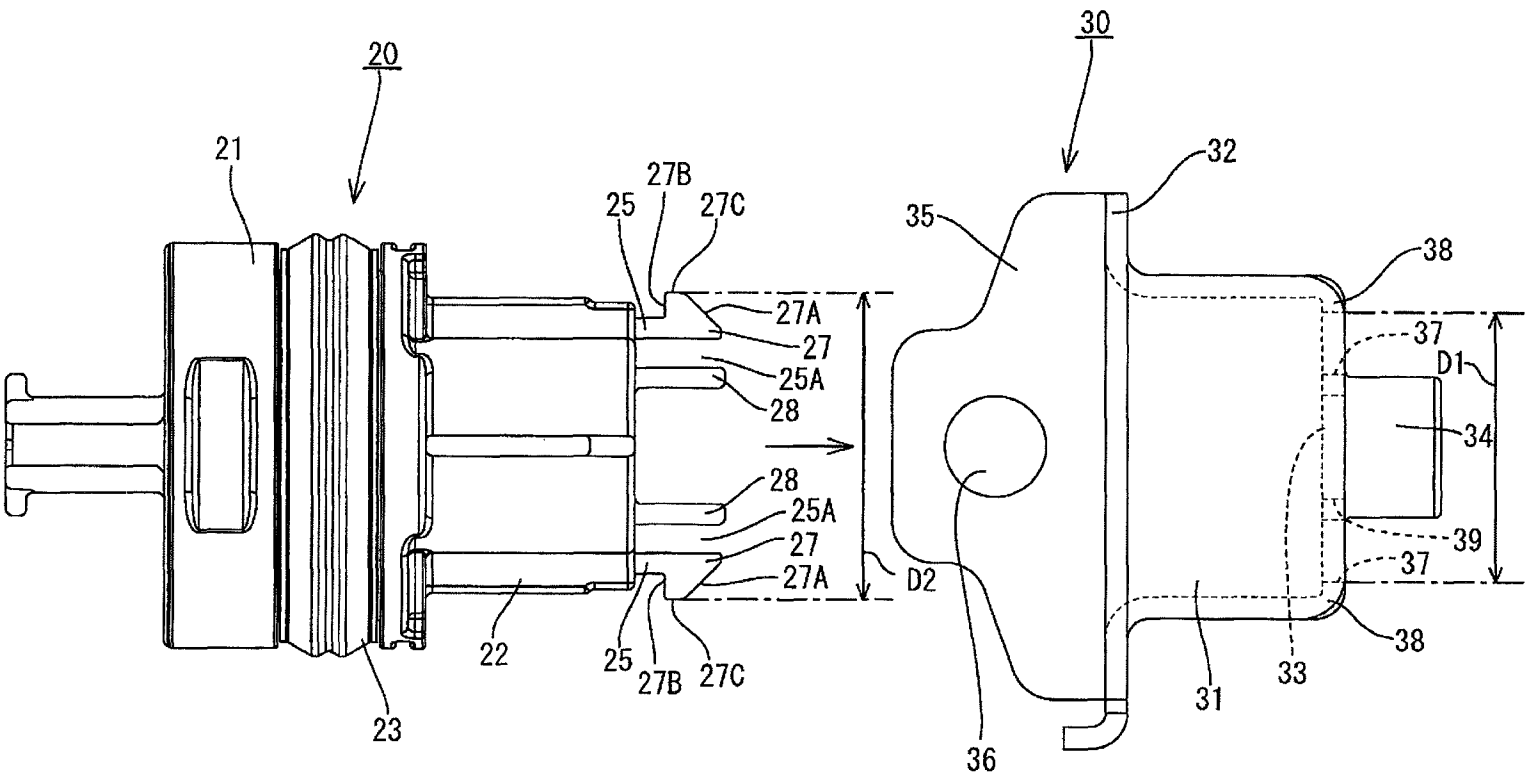
FIG. 5 is a side view showing a state before the connector housing and the individual core shield shell are assembled.
Figure 6:
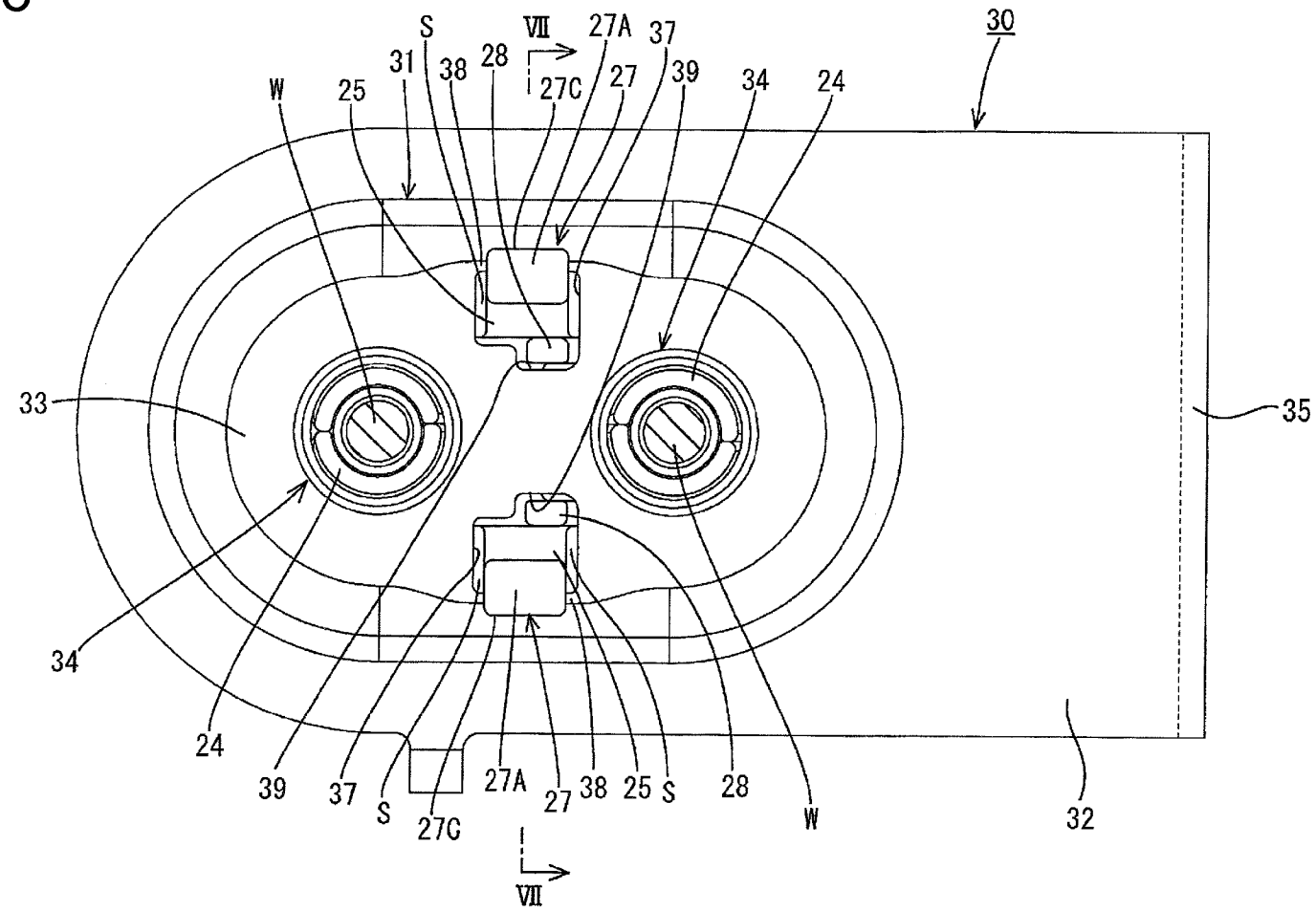
FIG. 6 is a rear view showing a state where the connector housing and the individual core shield shell are assembled.

On the other hand, a pair of upper and lower through holes 37, into which the resilient locking pieces 25 are insertable, are formed in the rear wall 33 of the individual core shield shell 30. The pair of through holes 37 are formed substantially in a widthwise central part of the rear wall 33 to penetrate through the rear wall 33 in the front-back direction. Further, widths of the through holes 37 are set to be larger than those of the resilient locking pieces 25. When the resilient locking pieces 25 are inserted into the through holes 37, tolerance absorbing spaces S are formed between the opposite end parts of the resilient locking pieces 25 in the width direction and inner surfaces of the through holes 37 located on opposite sides in the width direction as shown in FIG. 6. Further, an individual core side engaging portion 38 engageable with the locking projection 27 of the upper resilient locking piece 25 is formed on an upper opening edge of the upper through hole 37 over the entire width, and an individual core side engaging portion 38 engageable with the locking projection 27 of the lower resilient locking piece 25 is formed on a lower opening edge of the lower through hole 37 over the entire width. Further, a distance D1 between the individual-core side engaging portions which is a distance between the upper and lower individual-core side engaging portions 38 is set to be shorter than a distance D2 between the resilient locking pieces which is a distance between projecting ends 27C of the locking projections 27 of the both resilient locking pieces 25 as shown in FIGS. 5 and 7. That is, a length which is half the difference between the distance D2 between the resilient locking pieces and the distance D1 between the individual-core side engaging portions is the size of an engagement margin between the locking projection 27 of the resilient locking piece 25 and the individual-core side engaging portion 38. By this, when the individual core shield shell 30 is mounted onto the connector housing 20, the resilient locking pieces 25 of the connector housing 20 are respectively inserted into the through holes 37 of the individual core shield shell 30, the inclined surfaces 27A of the locking projections 27 come into contact with the individual-core side engaging portions 38 to be pressed toward the wire holding portion 22 and the both resilient locking pieces 25 are resiliently deformed toward the wire holding portion 22. When the locking projections 27 are inserted through the through holes 37, the resilient locking pieces 25 are resiliently restored and the individual-core side engaging portions 38 are locked by the locking surfaces 27B of the locking projections 27 from behind, whereby the individual core shield shell 30 is held and fixed to the connector housing 20.

Further, as shown in FIG. 9, a pair of collective side engaging portions 56 engageable with the resilient locking pieces 25 are respectively formed on opposite upper and lower sides in a substantially widthwise central part of an opening edge part of the collective insertion hole 53 of the collective shield shell 50. Widths of the collective side engaging portions 56 are set to be larger than those of the resilient locking pieces 25. When the resilient locking pieces 25 are inserted into the collective insertion hole 53, tolerance absorbing spaces S are formed between the opposite end parts of the resilient locking pieces 25 in the width direction and inner surfaces of the collective insertion hole 53 located on opposite sides in the width direction. Further, a distance D3 between the collective side engaging portions which is a distance between the upper and lower collective side engaging portions 56 is set to be shorter than the distance D2 between the resilient locking pieces as shown in FIG. 10. That is, a length which is half the difference between the distance D2 between the resilient locking pieces and the distance D3 between the collective side engaging portions is the size of an engagement margin between the locking projection 27 of the resilient locking piece 25 and the collective side engaging portion 56. By this, when the collective shield shell 50 is mounted onto the connector housing 20, the resilient locking pieces 25 of the connector housing 20 are respectively inserted into the collective insertion hole 53, the inclined surfaces 27A of the locking projections 27 come into contact with the collective side engaging portions 56 to be pressed toward the wire holding portion 22 and the both resilient locking pieces 25 are resiliently deformed toward the wire holding portion 22 similarly to the individual core shield shell 30. When the locking projections 27 are inserted through the collective insertion hole 53, the resilient locking pieces 25 are resiliently restored and the collective side engaging portions 56 are locked by the locking surfaces 27B of the locking projections 27 from behind, whereby the collective shield shell 50 is held and fixed to the connector housing 20.

Specifically, the individual core shield shell 30 or the collective shield shell 50 can be selectively held and fixed to the connector housing 20 by engaging the both resilient locking pieces 25 respectively with the both individual-core side engaging portions 38 of the individual core shield shell 30 or the both collective side engaging portions 56 of the collective shield shell 50. Specifically, the connector housing 20 can be shared by the collective shield shell 50 and the individual core shield shell 30. This can reduce the number of components and facilitate parts management as compared with the case where a dedicated connector housing is provided for each shield shell.

Note that a deformation space 25A for permitting the resilient deformation of the both resilient locking pieces 25 is provided at inner sides of the both resilient locking pieces 25, and an excessive deformation preventing rib 28 is at a position further inwardly of this deformation space 25A as shown in FIGS. 1 and 2. The excessive deformation preventing ribs 28 prevent the resilient locking pieces 25 from being excessively deformed by coming into contact with the resilient locking pieces 25, for example, if the individual core shield shell 30 or the collective shield shell 50 is mounted onto the connector housing 20 in a posture different from a proper mounting posture and the resilient locking pieces 25 are about to be excessively resiliently deformed. Further, the excessive deformation preventing ribs 28 are formed at positions deviated to the right from a widthwise center of the wire holding portion 22, whereas rib insertion grooves 39, into which the excessive deformation preventing ribs 28 are to be inserted, are formed at positions located on sides opposite to the individual-core side engaging portions 38 on the opening edge parts of the through holes 37 and deviated to the right from widthwise centers of the through holes 37. This prevents the excessive deformation preventing ribs 28 from being inserted into the rib insertion grooves 39 if the individual core shield shell 30 is mounted in a transversely reversed posture, thereby preventing the individual core shield shell 30 from being mounted onto the connector housing 20 in the transversely reversed posture.

This embodiment is configured as described above. Next, a method of fitting the connector housing 20 mounted with the individual core shield shell 30 into the mounting hole C1 of the case C is briefly described and functions and effects thereof are described. Note that since a method of mounting the connector housing 20 mounted with the collective shield shell 50 into the mounting hole C1 of the case C and functions and effects thereof are similar to those in the case of fitting the connector housing 20 mounted with the individual core shield shell 20, they are not described.

First, a front end part of the fitting portion 21 of the connector housing 20 is fitted into the mounting hole C1 of the case C, and the fitting portion 21 is inserted until the flange portion 32 of the individual core shield shell 30 comes into surface contact with the outer peripheral edge part of the mounting hole C1 of the case C, thereby being properly fitted. This causes the flange portion 32 of the individual core shield shell 30 and the case C to be shield-connected. Further, when the fitting portion 21 is properly fitted into the mounting hole C1, the rubber ring 23 externally fitted on the fitting portion 21 and the mounting hole C1 are held in close contact over the entire circumference, thereby sealing between the fitting portion 21 and the inner peripheral surface of the mounting hole C1.

Subsequently, the bolt B is inserted into the bolt insertion hole 36 of the mounting piece 35 and tightened into the right side surface of the case C, whereby the individual core shield shell 30 is reliably shield-connected to the case C and mounted and fixed to the case C.

A dimension between the fitting portion 21 and the mounting piece 35 may become larger or shorter than a proper dimension due to manufacturing tolerances of the connector housing 20 and the individual core shield shell 30 and an assembling tolerance between the connector housing 20 and the individual core shield shell 30. Thus, if the individual core shield shell 30 is fastened by the bolt B, the individual core shield shell 30 may be fixed to the case C while being displaced toward either side in the width direction, which is a tightening direction of the bolt B, relative to the connector housing 20. Thus, the sizes of the engagement margins between the resilient locking pieces and the individual-core side engaging portions may be reduced if resilient deforming directions of the resilient locking pieces are the same as the tightening direction of the bolt.

However, since the both resilient locking pieces 25 are formed to be resiliently deformable in the vertical direction, which is a direction intersecting with the tightening direction of the bolt B, according to this embodiment, the sizes of the engagement margins between the resilient locking pieces 25 and the individual-core side engaging portions 38 are not reduced even if the engaged positions of the both resilient locking pieces 25 and the individual-core side engaging portions 38 are slightly displaced in the width direction. Specifically, a reduction in the sizes of the engagement margins between the resilient locking pieces 25 and the individual-core side engaging portions 38 can be suppressed as compared with resilient locking pieces which are resiliently deformable in the same direction as the width direction as the tightening direction of the bolt. This can suppress a reduction in a force for locking the individual core shield shell 30 by the resilient locking pieces 25 as compared with the case where the tightening direction of the bolt and the resilient deforming directions of the resilient locking pieces are the same.

Further, since the tolerance absorbing spaces S are formed between the opposite end parts of the resilient locking pieces 25 inserted into the through holes 37 in the width direction and the inner surfaces of the through holes 37 located on the opposite sides in the width direction according to this embodiment, the application of a stress caused by bolt tightening between the opening edge parts located on the opposite sides of the through holes 37 in the width direction and the opposite end parts of the resilient locking pieces 25 in the width direction can be reduced as compared with the case where widths of the individual-core side engaging portions and those of the resilient locking pieces are the same.

Furthermore, since the both resilient locking pieces 25 are formed at the opposite upper and lower sides of the wire holding portion 22, from which the plurality of wires W are drawn out, according to this embodiment, the individual core shield shell 30 can be held in a well-balanced manner at the opposite upper and lower sides of the wire holding portion 22. This can improve a force for locking the individual core shield shell 30 by the resilient locking pieces 25.

The present invention is not limited to the above described and illustrated embodiment. For example, the following embodiments are also included in the technical scope of the present invention.

(1) Although the pair of resilient locking pieces are formed at the opposite upper and lower sides of the wire holding portion 22 in the above embodiment, the present invention is not limited to such a mode. For example, three or more resilient locking pieces may be formed at each of the opposite upper and lower sides of the wire holding portion 22 and the numbers of the resilient locking pieces may be different at the opposite upper and lower sides.

(2) Although the individual core shield connecting portions 34 are formed on the rear wall 33 of the shell main body 31 of the individual core shield shell 30 in the above embodiment, the present invention is not limited to such a mode. For example, individual core shield connecting portions may be directly formed on a flange portion.

(3) Although two wires are held in the wire holding portion 22 and two individual core shield connecting portions 34 are formed on the rear wall 33 of the individual core shield shell 30 in the above embodiment, the present invention is not limited to such a mode. For example, three or more wires may be held in a wire holding portion and three or more individual core shield connecting portions may be formed on a rear wall.

The invention claimed is:

1. A shield connector, comprising:

a connector housing which is made of synthetic resin, from which a plurality of wires are drawn out, and which includes a resilient locking piece provided resiliently deformably in a direction intersecting with a draw-out direction in which the plurality of wires are drawn out;

a collective shield shell which is made of metal and includes a collective shield connecting portion, which is open in the draw-out direction of the plurality of wires and into which the plurality of wires are collectively inserted, a collective side engaging portion engageable with the resilient locking piece being formed on the collective shield connecting portion; and an individual core shield shell which includes a wall portion arranged to intersect with the draw-out direction of the plurality of wires, a plurality of individual core shield connecting portions, which are open in the draw-out direction of the plurality of wires, being provided on the wall portion, whereby the plurality of wires are individually inserted into the individual core shield connecting portions, and an individual-core side engaging portion, which is an opening edge part of a through hole engageable with the resilient locking piece being formed on the wall portion;

wherein the collective shield shell or the individual core shield shell is selectively fixed to the connector housing by resiliently restoring the resiliently deformed resilient locking piece and engaging the resilient locking piece with the collective side engaging portion when the collective shield shell is mounted onto the connector housing or by resiliently restoring the resiliently deformed resilient locking piece and engaging the resilient locking piece with the individual-core side engaging portion when the individual core shield shell is mounted onto the connector housing;

the connector housing is formed to be fittable into a mounting hole provided on a case made of metal;

each of the collective shield shell and the individual core shield shell is formed with a mounting piece for mounting the shield shell on the case by tightening a bolt into the case in a direction intersecting with a fitting direction of the connector housing; and the resilient locking piece is formed to be resiliently deformable in a direction intersecting with both the fitting direction of the connector housing and a tightening direction of the bolt.

2. A shield connector according to claim 1, wherein an opening of the collective shield connecting portion and an opening of the through hole are formed to be larger than the resilient locking piece in a width direction.

3. A shield connector according to claim 1, wherein the resilient locking piece is formed at each of opposite sides of a wire draw-out portion from which the plurality of wires are drawn out.

* * * * *